United States Patent [19]

Wilcher

[11] 4,207,909

[45] Jun. 17, 1980

[54] LIQUID APPLICATOR

[76] Inventor: Gene E. Wilcher, 2806 Browntown Rd., Atlanta, Ga. 30369

[21] Appl. No.: 805,518

[22] Filed: Jun. 10, 1977

[51] Int. Cl.[2] ..... A45D 40/30

[52] U.S. Cl. ..... 132/88.5

[58] Field of Search ..... 132/88.5, 88.7, 9; 128/65; 15/402; 401/209

[56] References Cited

U.S. PATENT DOCUMENTS

| | | | |
|---|---|---|---|
| 1,089,683 | 3/1914 | Stapler | 401/209 |
| 1,161,719 | 11/1915 | Norton | 128/65 |
| 1,859,132 | 5/1932 | Fechtenburg | 15/402 |
| 2,120,769 | 6/1938 | Rychner | 132/9 |
| 2,519,740 | 8/1950 | Call | 132/115 |
| 2,922,425 | 1/1960 | Lerner et al. | 132/9 |
| 2,977,320 | 3/1961 | Jenkins | 401/209 X |
| 3,281,933 | 11/1966 | Fehling et al. | 401/209 X |

*Primary Examiner*—G.E. McNeill

[57] ABSTRACT

A liquid applicator formed in the shape of a person's hand, the applicator having a central body from which protrude a plurality of spaced arcuate fingers. The arm or shank of the applicator has a removable cap and a hollow interior which communicates with the hollow interior of the body of the applicator and the hollow interior of the fingers. The distal ends of the fingers are provided with balls or roller applicators which meter the amount of liquid applied to the scalp. The fingers are flat and tapered to a point so as to facilitate the removal of loose dandruff, forwardly of the balls. A reservoir restricts the flow of liquid so as to maintain liquid in the forward end of the applicator and a base on the body enables the applicator to rest on a flat surface.

5 Claims, 6 Drawing Figures

LIQUID APPLICATOR

BACKGROUND OF THE INVENTION

1. Field of the Invention

This invention relates to a liquid applicator and is more particularly concerned with an applicator for applying liquid to the scalp of a person.

2. Description of the Prior Art

Numerous devices have been employed for applying liquid to the scalp of a person. Usually these devices are hollow combs through which liquid is fed down through the teeth of the comb and into the scalp. With continued use, the discharge ends of these teeth become clogged and hence liquid is applied unevenly or, in some instances, not all. Furthermore, utilizing the prior art devices it is difficult to lift the dry dandruff and apply metered amounts of liquid to the scalp. Furthermore, prior art devices are not contoured to fit the head in such a way as to plow through wiry hair and apply liquid from various discharge ports simultaneous onto the scalp, itself. Hence, with the prior art devices, much liquid is applied to the hair rather than primarily to the scalp.

SUMMARY OF THE INVENTION

Briefly described, the present invention, which overcomes the difficulties described above, includes a hand shaped hollow tubular member having a filling cap at one end and a plurality of protruding arcuate fingers at the other. The fingers protrude forwardly from the body of the applicator. The body communicates with one end of the arm or shank of the applicator, the other end of which threadedly receives the cap.

Each of the fingers is provided with a flat angularly disposed bottom surface and contains a roller by means of which controlled amounts of liquid are applied to the scalp. The fingers, in the vicinity of the rollers, are each tapered forwardly to a point so as to provide elements which tend to loosen the dandruff and loose skin on the scalp, immediately prior to the application of the liquid to the scalp, itself.

The device also includes a reservoir which will collect the liquid in the finger portion of the applicator. A flat base is also provided by means of which the applicator can be placed on a flat surface in an inverted position.

DESCRIPTION OF THE PREFERRED EMBODIMENT

Figure 1:
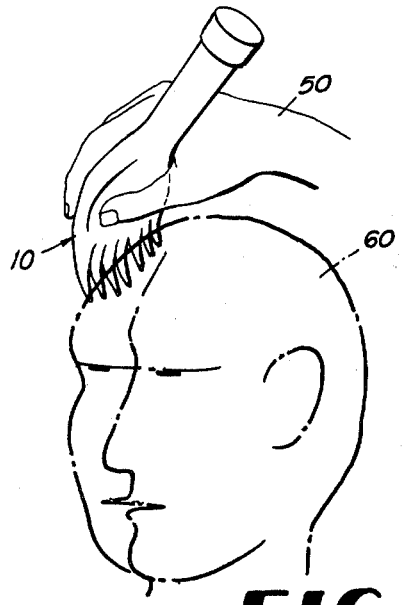
FIG. 1 is a prospective view of a person's head and hand, the hand grasping a liquid applicator constructed in accordance with the present invention.

Referring now in detail to the embodiment chosen to illustrate the present invention, the liquid applicator 10 has a unitary hollow tubular body formed in the shape of an arched hand with extended curved fingers. In more detail, the applicator 10 includes a hollow body 11 which as an upper or palm wall 12 and a lower or outer wall 13 joined by converging sides 14*a* and 14*b*. Thus, the central body 11 has, at its proximal end 61, a relatively small round opening and at its distal end 17, a relatively wide, oval-shaped opening and a hollow interior 18.

Figure 3:
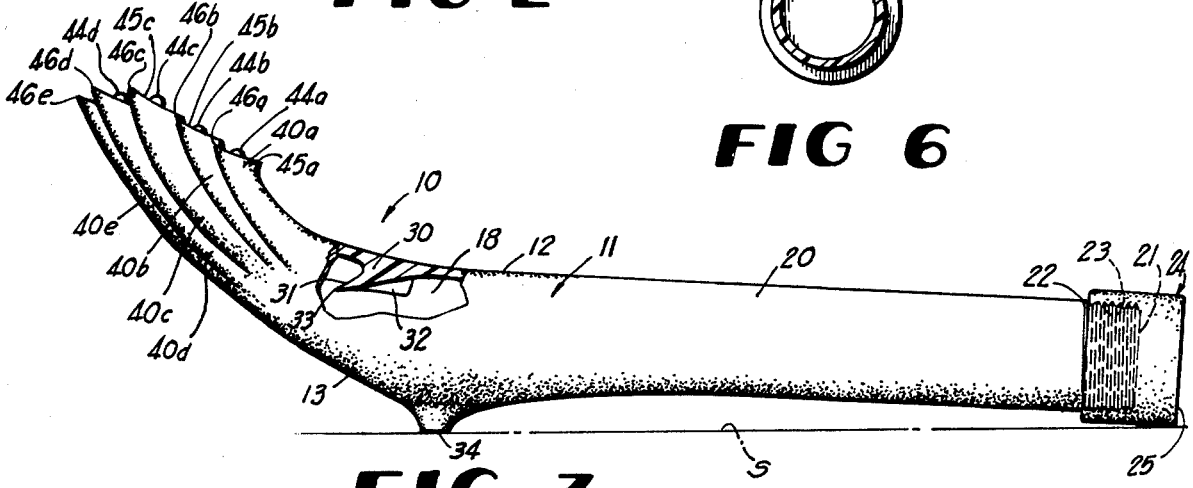
FIG. 3 is a side elevational view, partially broken away, of the applicator shown in FIGS. 1 and 2.

The proximal end 16 of the body 11 is integrally joined to and communicates with a hollow, cylindrical, tubular shank or arm 20, the shank or arm 20 being open at both ends. The proximal end or rear end 21, indicated by broken lines in FIG. 3, is for the purpose of receiving the liquid to be dispensed. This rear end portion is externally threaded at numeral 22 for receiving the internal thread 23 of a tubular cylindrical removable cap 24.

Cap 24 has an outer radially extending end plate 25 for closing the outer end of the cap 24. By manipulation of cap 24, it can be removed so that liquid, to be applied to the scalp, can be pured into the hollow interior 18 of shank 20.

The distal end 17 of central body 13 has, along the interior surface of upper wall 13 an inwardly protruding arcuate dam or partition 30. Partition 30 extends from side 14*a* to side 14and has a concaved and forwardly inclined front wall 31 and a straight forwardly inclined rear wall 32 joined along a straight spillway edge 33.

The applicator end 40 has a plurality of spaced fingers 40*a*, 40*b*, 40*c*, 40*d*, 40*e*, 40*f* and 40*g* which are arcuate forwardly tapered members disposed in juxtaposition, in an array closing the distal end 17 of the central body 11.

Figure 4:
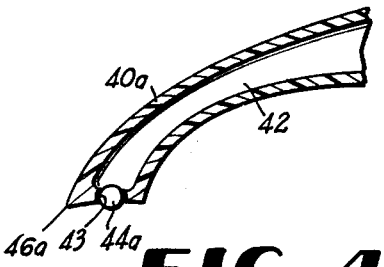
FIG. 4 is an enlarged vertical sectional view taken substantially along line 4—4 in FIG. 2.

Each finger, such as finger 40*a*, has a hollow interior 42, communicating with the hollow interior 18. The distal ends 45*a*, 45*b*, 45*c*, 45*d*, 45*e*, 45*f* and 45*g* of the fingers 40*a*, 40*b*, 40*c*, 40*d*, 40*e*, 40*f* and 40*g* respectively are each flat and inclined so as to be parallel with each other and almost parallel to the palm wall 12. A recess or aperture in each finger end, such as aperture 43, receives and rotatably retains an applicator ball, such as ball 44*a*, therein. Thus fingers 40*a*, 40*b*, 40*c* and 40*d* are shown in FIG. 4 as totatably retaining balls 44*a*, 44*b*, 44*c* and 44*d* protruding from their finger ends.

Figure 5:
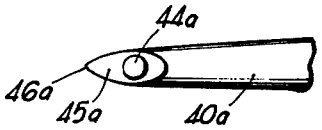
FIG. 5 is a bottom plan view of the portion shown in FIG. 4.
Figure 2:
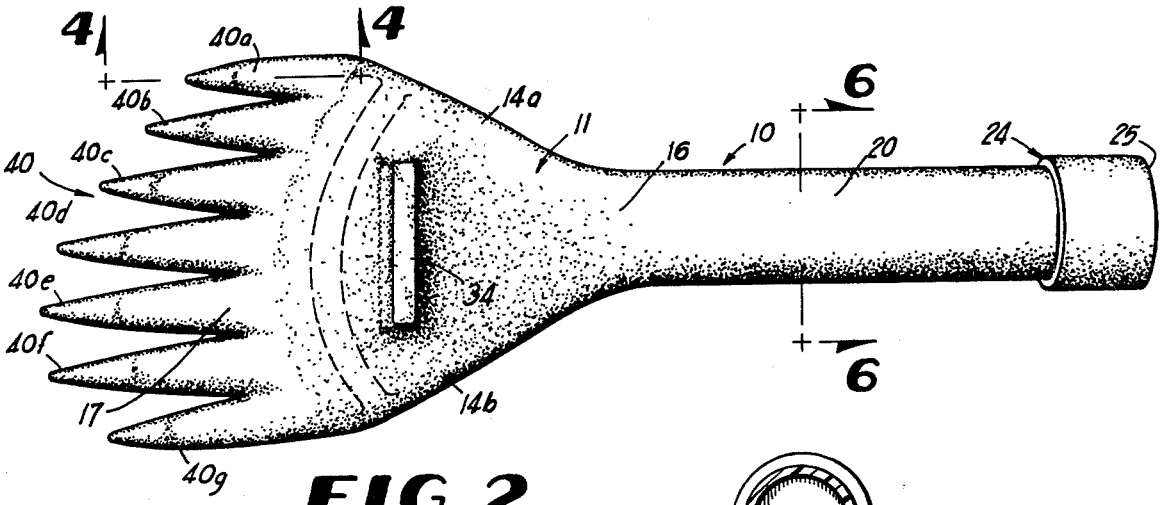
FIG. 2 is a bottom plan view of the applicator shown in FIG. 1.
Figure 6:
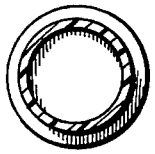
FIG. 6 is a cross section view taken substantially along line 6—6 in FIG. 5.

Each end 45*a*, 45*b*, 45*c*, 45*d* and 45*e* is oval shaped, as shown in FIG. 5 for end 45*a*, and tapers to a pointed forward tip, such as tips 46*a*, 46*b*, 46*c* and 46*e*.

The length and curvature of fingers 40*a*, 40*b*, 40*c*, 40*d*, 40*e*, 40*f* and 40*g* are along a curve corresponding to the curvature of the head, so that the fingers will simultaneously contact the scalp.

The applicator end 40, the body 11 and shank 20 are molded from plastic and are integrally joined to form a unitary structure.

The back wall 13 is provided with a transversely extending, outwardly protruding base 34, forwardly of the center of gravity of the applicator 10, so that the applicator 10 can rest in an inverted position upon a flat surface S, as shown in FIG. 3.

In operation, liquid is placed in the hollow interior and the applicator 10 is grasp in a person's hand 50, as shown in FIG. 1. The applicator 10 is then moved over the scalp 60 sufficiently that the balls, such as balls 44*a*, 44*b*, 44*c* and 44*d* rotate to carry liquid from the interior, such as interior 42 to the scalp as it rolls over the surface of the scalp. The tips 46*a*, 46*b*, 46*c*, 46*d* and 46*e* tend to part the hair and, if the applicator 10 is appropriately tilted, the tips will scratch the scalp and extract loose skin or dandruff.

The function of dam 30 is to creat a reservoir so as to tend to retain the liquid in the fingers 40*a*, 40*b*, 40*c*, 40*d*, 40*e*, 40*f* and 40*g* of the applicator 10, regardless of whether or not the applicator is vigorously moved.

What is claimed is:

1. An applicator for applying liquid to the scalp of a person comprising, a hollow body for receiving and retaining said liquid, a rigid hollow generally cylindrical shank integrally joined to and protruding rearwardly from the proximal end of said body, said shank forming a handle by which the applicator is held, the hollow interior of said shank communicating with the hollow interior of said body for forming therewith a common reservoir for said liquid, a removable cap on the end of said shank, a plurality of substantially rigid hollow juxtaposed individual tubular fingers extending forwardly from the distal end of said body, said fingers being arcuate and curved forwardly and downwardly and provided with space forwardly tapering and pointed tips disposed in a transverse arc, the hollow interior of said fingers communicating with the hollow interior of said body, the end portions of said fingers being generally flat, and applicator roller means substantially smaller than said end portions and respectively rotatably carried by and in the flat end portions of said fingers inwardly of said tips for applying said liquid from the interior of said fingers to the scalp of a person after said tips have parted the hair adjacent to the scalp.

2. The applicator defined in claim 1 wherein said body is a tapered member and wherein said shank is a cylindrical member integrally connected to the small end of said tapered member, the fingers projecting from the larger end of said tapered member.

3. The applicator defined in claim 1 wherein said fingers are arcuate and curved in the same direction.

4. The applicator defined in claim 3 including an outwardly protruding base on a side of said body opposite to the direction of curvature of said fingers, said base having a flat outer surface spaced from said body, said flat outer surface and said cap forming a support for said applicator, for supporting the same in an inverted position.

5. The applicator defined in claim 3 including a dam across the interior of said body for creating reservoir to retain liquid in said fingers.

* * * * *